US007650650B2

(12) United States Patent
Voege

(10) Patent No.: US 7,650,650 B2
(45) Date of Patent: Jan. 26, 2010

(54) T-SHIRT WITH ROLLED SLEEVES

(76) Inventor: James A. Voege, 15022 Coral Ct., Carmel, IN (US) 46032

( * ) Notice: Subject to any disclaimer, the term of this patent is extended or adjusted under 35 U.S.C. 154(b) by 278 days.

(21) Appl. No.: 11/132,492

(22) Filed: May 19, 2005

(65) Prior Publication Data

US 2006/0260025 A1 Nov. 23, 2006

(51) Int. Cl.
*A41D 27/10* (2006.01)

(52) U.S. Cl. ..... 2/269; 2/125

(58) Field of Classification Search ..... 2/269, 2/123, 125, 126, 59, 60, 338, 115, 320, 321, 2/270, 124
See application file for complete search history.

(56) References Cited

U.S. PATENT DOCUMENTS

| | | | | | |
|---|---|---|---|---|---|
| 237,096 | A | * | 2/1881 | Delmonte | 2/269 |
| 560,683 | A | * | 5/1896 | Bruckner | 2/227 |
| 811,662 | A | * | 2/1906 | Puryear | 2/269 |
| 823,534 | A | * | 6/1906 | Hutchinson | 2/269 |
| 858,845 | A | * | 7/1907 | Wurtemberg | 2/124 |
| 1,012,897 | A | * | 12/1911 | Nathan | 2/232 |
| 1,085,399 | A | * | 1/1914 | Bauer | 2/269 |
| 1,085,791 | A | * | 2/1914 | Berkenfeld | 2/93 |
| 1,147,155 | A | * | 7/1915 | Farlow | 2/126 |
| 1,157,265 | A | * | 10/1915 | Tutelman | 2/269 |
| 1,174,775 | A | * | 3/1916 | Thorman | 2/270 |
| 1,552,927 | A | * | 9/1925 | Washington | 2/269 |
| 1,670,644 | A | * | 5/1928 | Morris | 2/123 |
| 1,951,437 | A | * | 3/1934 | Parfitt | 2/269 |
| 2,153,068 | A | * | 4/1939 | Arden | 2/269 |
| 2,187,447 | A | * | 1/1940 | Chait et al. | 2/227 |
| 2,328,137 | A | * | 8/1943 | Goldberg | 2/269 |
| 2,352,614 | A | * | 7/1944 | Brown | 2/269 |
| 2,414,429 | A | * | 1/1947 | Solomon | 2/269 |
| 2,420,162 | A | * | 5/1947 | Baker | 2/269 |
| 2,449,579 | A | * | 9/1948 | Barnes | 2/309 |
| 2,524,814 | A | * | 10/1950 | Leaf | 2/269 |
| 2,626,396 | A | * | 1/1953 | Kanin | 2/269 |
| 2,705,806 | A | * | 4/1955 | Williamson | 2/115 |
| 2,713,685 | A | * | 7/1955 | Nachem | 112/424 |
| 2,719,981 | A | * | 10/1955 | Frank | 2/269 |
| 2,876,456 | A | * | 3/1959 | Johnson | 2/269 |
| 3,486,507 | A | * | 12/1969 | Arnold et al. | 450/104 |
| 4,068,316 | A | * | 1/1978 | Haywood | 2/126 |
| 4,149,275 | A | * | 4/1979 | Sanchez | 2/269 |
| 4,200,938 | A | * | 5/1980 | LeTourneau | 2/269 |

(Continued)

OTHER PUBLICATIONS

Lands' End Men's Stripe Performance Polo Shirt, www.landsend.com, May 17, 2005, 5 pgs.

(Continued)

*Primary Examiner*—Alissa L Hoey
(74) *Attorney, Agent, or Firm*—Baker & Daniels LLP

(57) ABSTRACT

A T-Shirt is disclosed having rolled sleeves and a torso portion configured to cover a portion of a torso of the person. In one embodiment, the rolled sleeves may be secured in place. In another embodiment, the rolled sleeves may include a snugging member to assist in contouring the sleeve to the wearer's arm. In one embodiment, the T-Shirt may further include a securing member configured to secure the rolled sleeve in place, the securing member being hidden from view from an exterior of the rolled sleeve when the shirt is worn by a person.

18 Claims, 8 Drawing Sheets

U.S. PATENT DOCUMENTS

| | | | | | |
|---|---|---|---|---|---|
| 4,259,751 | A | * | 4/1981 | Drmaj | 2/269 |
| 4,475,252 | A | * | 10/1984 | Peyser et al. | 2/125 |
| 4,602,389 | A | * | 7/1986 | Brown | 112/475.13 |
| 4,631,753 | A | * | 12/1986 | Ehring | 2/85 |
| 4,697,288 | A | * | 10/1987 | Palumbo | 2/269 |
| 4,896,379 | A | * | 1/1990 | Kape | 2/269 |
| 5,088,128 | A | * | 2/1992 | Kape | 2/269 |
| 5,404,592 | A | * | 4/1995 | Jackson | 2/125 |
| 5,535,453 | A | * | 7/1996 | Howard | 2/269 |
| 5,539,932 | A | * | 7/1996 | Howard | 2/269 |
| 5,575,010 | A | * | 11/1996 | Chung | 2/227 |
| 5,669,077 | A | * | 9/1997 | Stewart | 2/227 |
| 5,692,239 | A | | 12/1997 | Lewis | |
| 5,708,977 | A | * | 1/1998 | Morkunas | 2/80 |
| 5,787,511 | A | * | 8/1998 | Garside | 2/269 |
| 5,903,928 | A | * | 5/1999 | Hyung-Seob | 2/244 |
| 6,081,925 | A | | 7/2000 | Reiber | |
| 6,148,445 | A | | 11/2000 | Spruill | |
| 6,175,961 | B1 | | 1/2001 | Linden et al. | |
| 6,272,691 | B1 | * | 8/2001 | Henricksen et al. | 2/338 |
| 6,314,581 | B1 | * | 11/2001 | Bond | 2/129 |
| 6,317,894 | B1 | * | 11/2001 | Blechman | 2/269 |
| 6,353,935 | B1 | * | 3/2002 | Antonini | 2/115 |
| 6,438,758 | B1 | * | 8/2002 | Burkard et al. | 2/115 |
| 6,654,968 | B2 | * | 12/2003 | Braun et al. | 2/269 |
| 6,775,846 | B1 | | 8/2004 | LaFauci et al. | |
| 6,865,751 | B1 | * | 3/2005 | Brasher | 2/269 |
| 7,039,958 | B2 | * | 5/2006 | Henricksen | 2/338 |
| 7,305,717 | B1 | * | 12/2007 | Brown | 2/114 |
| 7,340,780 | B2 | * | 3/2008 | Levy | 2/115 |
| 2001/0052143 | A1 | * | 12/2001 | Oster | 2/126 |
| 2004/0111784 | A1 | | 6/2004 | Henricksen | |
| 2006/0218693 | A1 | * | 10/2006 | Sinohui | 2/115 |

OTHER PUBLICATIONS

Dick's Sporting Goods—Under Armour: Under Armour Heat Gear Full T-Shirt Mens, www.dickssportingoods.com, May 9, 2005, 3 pgs.

Epinions, Compare Prices and Read Reviews on A.K.A. Roll Sleeve Shirt by A.K.A (For Women), www.epinions.com, Mar. 3, 2005, 2 pgs.

Stitches Magazine, The white tee takes center stage—again, www.stitches.com, Jan. 1, 1999, 2 pgs.

Cops Plus, 511 Tactical Long Sleeve Shirt (Men's Sizes XXL to XXXL), www.copsplus.com, Mar. 3, 2005, 3 pgs.

* cited by examiner

T-SHIRT WITH ROLLED SLEEVES

BACKGROUND

The present disclosure relates to clothing apparel and in particular to T-Shirts having rolled sleeves.

At various times it has been popular to roll up the sleeves of a basic short sleeve T-Shirt. Often times cigarettes would be stored in at least one of the rolled sleeves of a T-Shirt. One of the traditional problems of rolling up a sleeve of a T-Shirt has been that the rolled sleeve tends to unroll during wear, such as during activity. Further, it is known to use a visible decorative rivet on a rolled sleeve.

SUMMARY OF THE INVENTION

In an exemplary embodiment of the present invention, a short sleeve shirt for wear by a person is provided. The shirt includes a torso portion configured to cover a portion of a torso of the person, a sleeve made from an original sleeve material, and a securing member configured to secure a rolled sleeve portion in place. The securing member is hidden from view from the exterior of the rolled sleeve portion when the shirt is worn by the person. The sleeve is coupled to the torso portion at a seam and configured to cover at least a portion of an upper arm of the person when the shirt is worn by the person. The seam has a top portion generally positioned adjacent a shoulder of the person when the shirt is worn by the person. The sleeve is illustratively rolled from a lower edge of the sleeve about a circumference of the sleeve to produce a rolled sleeve portion including at least three layers of the original sleeve material. A top edge of the rolled sleeve portion is illustratively at least about 3 inches from the top portion of the seam. In one example, the securing member is a permanent type securing member. In another example, the securing member is a releasable type securing member.

In another exemplary embodiment of the present invention, a method of rolling a sleeve of a short sleeve T-Shirt is provided. The method includes the steps of rolling the sleeve up from a lower edge at least two times such that at least three layers of the original sleeve material are generally concentrically arranged as a rolled sleeve portion; securing to the sleeve a snugging member which is configured to contour the rolled sleeve to the wearer's arm; and securing the rolled sleeve portion in place with a securing member such that the rolled sleeve portion does not unroll and such that the securing member is not visible from an exterior of the rolled sleeve portion.

In a further exemplary embodiment of the present invention, a short sleeve shirt for wear by a person is provided. The shirt includes a torso portion configured to cover a portion of a torso of the person; a sleeve made from an original sleeve material, the sleeve being coupled to the torso portion at a seam and configured to cover at least a portion of an upper arm of the person when the shirt is worn by the person. The sleeve is illustratively rolled from a lower edge of the sleeve about a circumference of the sleeve to produce a rolled sleeve portion including at least three layers of the original sleeve material. A snugging member is configured to contour the rolled sleeve portion to the upper arm of the person when the shirt is worn by the person. A securing member is configured to secure the rolled sleeve portion in place. The securing member is illustratively hidden from view from the exterior of the rolled sleeve portion when the shirt is worn by the person. In one example, the rolled sleeve portion has a generally constant width about the circumference of the sleeve. In another example, the snugging member is illustratively hidden from view from the exterior of the rolled sleeve portion when the shirt is worn by the person;

Additional features of the invention will become apparent to those skilled in the art upon consideration of the following detailed description of illustrative embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
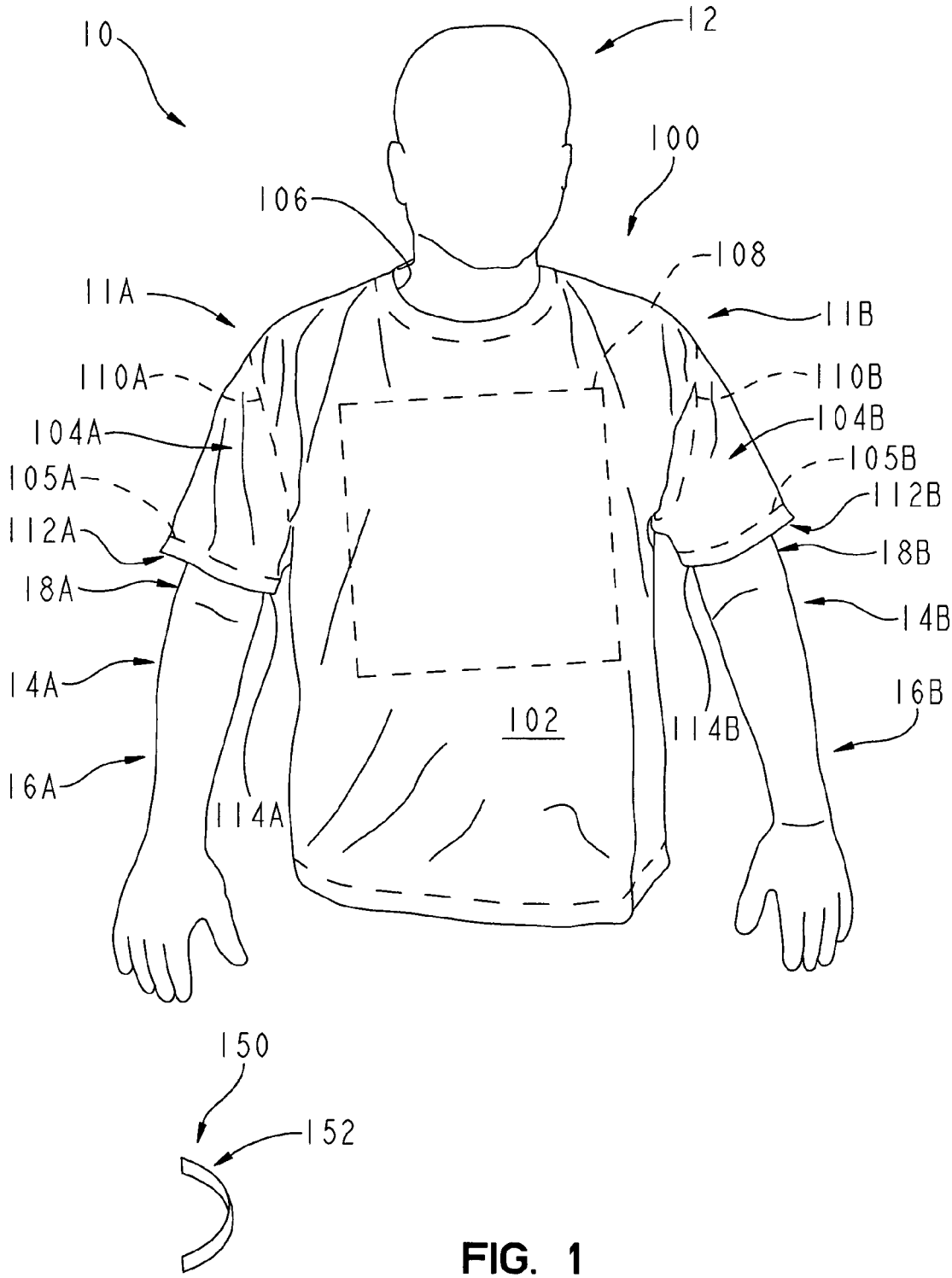
FIG. 1 is a front view of an exemplary T-Shirt and a perspective view of an exemplary snugging member.

Referring to FIG. 1, a T-Shirt 100 is shown. T-Shirt 100 has a body or torso portion 102 and two sleeves 104A, 104B. When being worn by an individual, body portion 102 includes an unopenable lower edge and covers a torso (not shown) of a person 10 and permits a head 12 of the person to extend through an opening 106 in torso portion 12. In one embodiment, T-Shirt 100 includes one or more regions including indicia, such as region 108. Each of sleeves 104A, 104B is connected to torso portion 102 at a respective seam 110A, 110B and includes an opening 112A, 112B to permit a respective arm 14A, 14B to extend there through. Arms 14A, 14B include a lower arm portion 16A, 16B and an upper arm portion 18A, 18B. A lower edge 114A of sleeve 104A and a lower edge 114B of sleeve 104B are unopenable.

The following illustrative discussion deals with the right sleeve 104A of T-Shirt 10. However, it should be appreciated that the illustrative discussion is equally, and in one embodiment preferably, also applicable to the left sleeve 104B.

Figure 2:
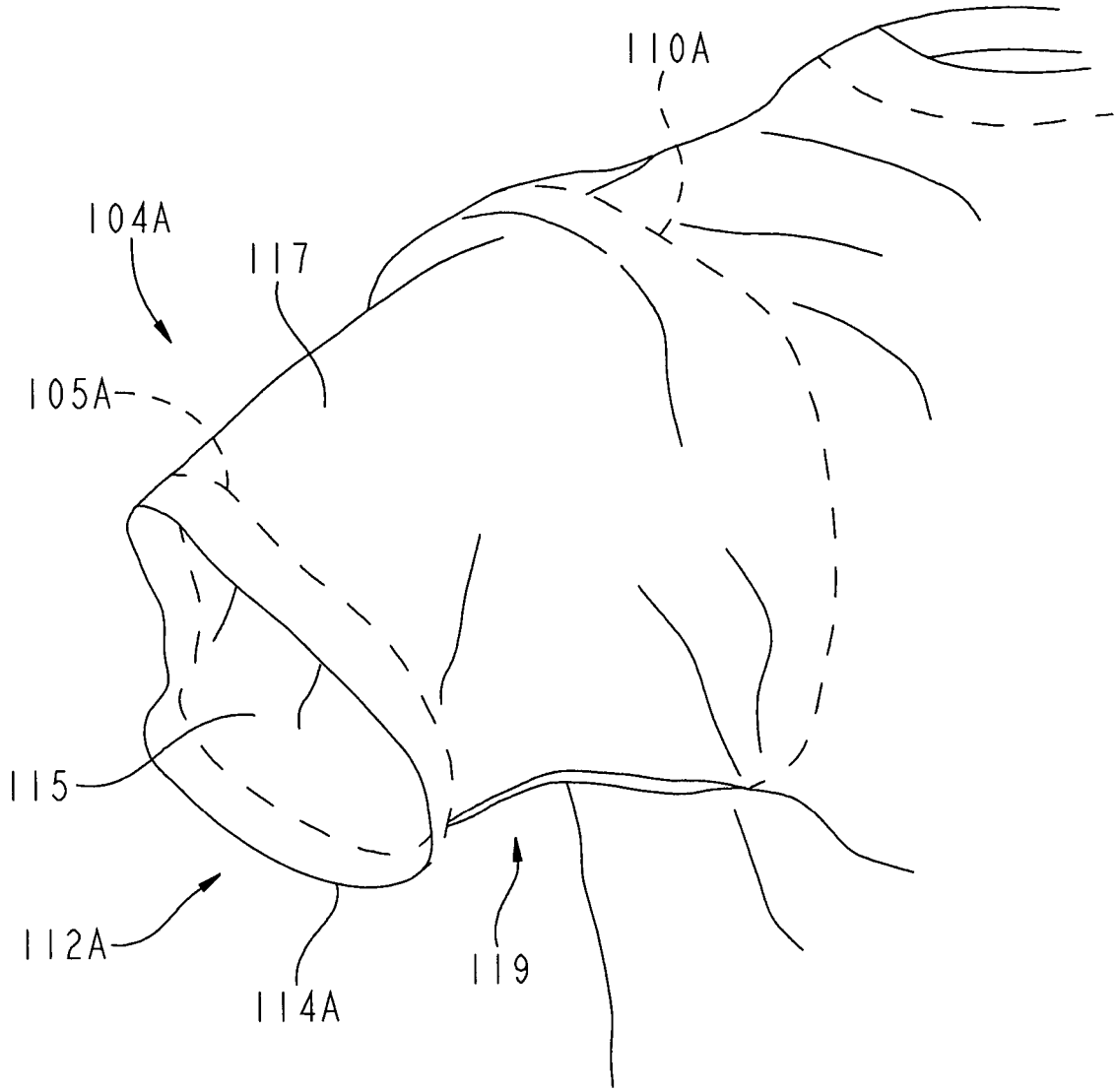
FIG. 2 is a perspective view of a portion of the T-Shirt of FIG. 1 including a right sleeve.

As used herein the term "original sleeve material" is defined as the cloth, fabric, or other suitable material used in the manufacture of the shirt prior to rolling the sleeves and includes multi layer cloth, fabric, or other suitable material used to manufacture the shirt. As such, original sleeve material includes sleeve ends that are unbound or that have been hemmed or otherwise processed to produce a durable lower edge. For illustrative purposes, sleeve 104A is shown as being hemmed by stitching 105A in FIGS. 1 and 2 and unhemmed in FIGS. 3-7. However, the discussion herein is equally applicable to both hemmed sleeves and unhemmed sleeves.

One manner of wearing T-Shirt 100 is to roll-up a lower edge 114A, 114B of respective sleeves 104A, 104B such that the resultant rolled sleeve portion 116A (see FIG. 4) is generally positioned about the bicep of the respective upper arm portion 18A, 18B. The resultant rolled sleeve portion 116A may be centered on the widest portion of the bicep, positioned above the widest portion of the bicep, or positioned below the widest portion of the bicep.

Figure 3:
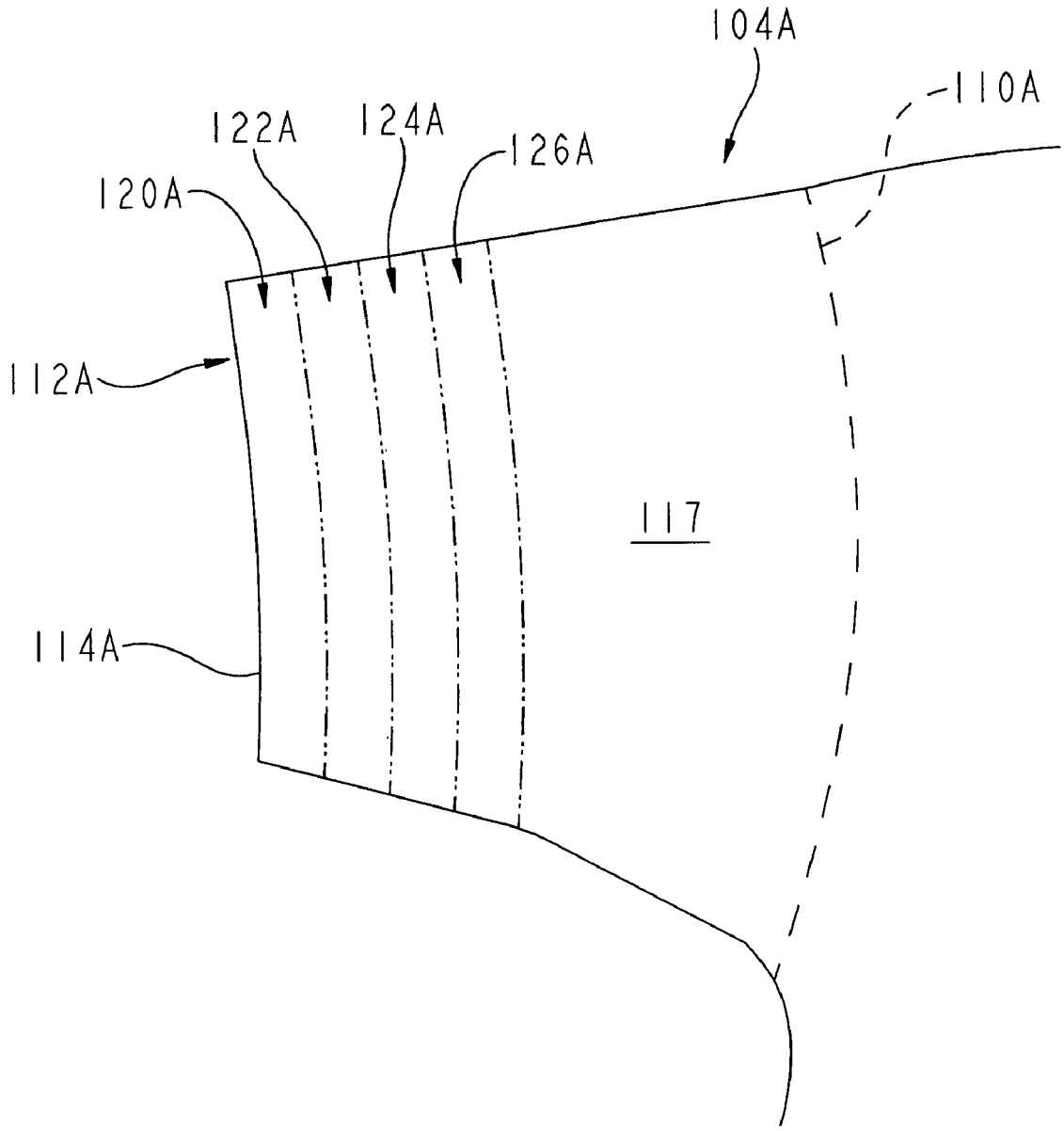
FIG. 3 is a front view of a portion of the T-Shirt of FIG. 1 including a right sleeve unrolled.
Figure 4:
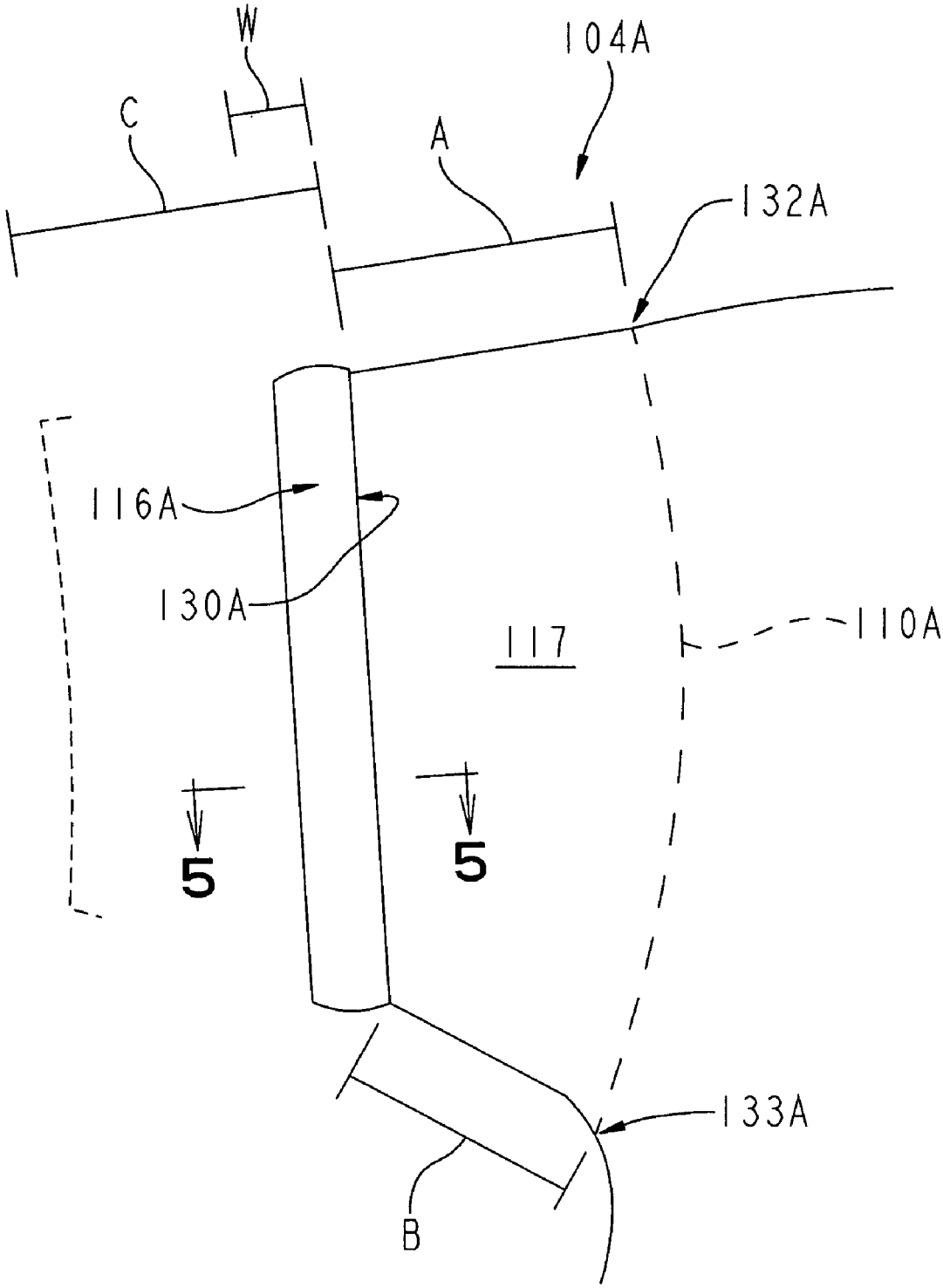
FIG. 4 is a front view of a portion of the T-Shirt of FIG. 1 including a right sleeve rolled.

Referring to FIGS. 3 and 4, a lower edge 114A of sleeve 104A is rolled up such that a first section 120A of sleeve 104A overlays a second section 122A of sleeve 104A. This produces a rolled sleeve portion having two layers of original sleeve material. Next, the combination of first section 120A and second section 122A is rolled up such that the combination overlays a third section 124A of sleeve 104A. This produces a rolled sleeve portion having three layers of original sleeve material. Next, the combination of sections 120A, 122A, 124A is rolled up such that the combination overlays a fourth section 126A of sleeve 104A. This produces rolled sleeve portion 116A having four layers of original sleeve material. The process may be continued for multiple rolls of sleeve 104A.

T-Shirt 100 is illustratively shown having a rolled sleeve portion 116A with four layers of original sleeve material. However, sleeve 104A may be rolled to have fewer or more layers of original sleeve material depending on the length of the sleeve 104A and the desired position of the rolled portion 116A on the upper arm portion 18A. In one embodiment, sleeve 104A includes at least three layers of original sleeve material. In another embodiment, sleeve 104A includes at least four layers of original sleeve material. In a further embodiment, sleeve 104A includes at least five layers of original sleeve material.

In one embodiment, an upper edge 130A of the rolled sleeve portion, illustratively rolled sleeve portion 116A, is at least about 3 inches from a top portion 132A of seam 110A (indicated as "A" in FIG. 4) located generally proximate to wearer's 12 shoulder 11A. In another embodiment, the rolled sleeve portion 116A is at least about 6 inches from top portion 132A of seam 110A. In a further embodiment, the rolled sleeve portion 116A is between about 3 inches and about 6 inches from top portion 132A of the seam 110A.

In one embodiment, upper edge 130A of the rolled sleeve portion, illustratively rolled sleeve portion 116A, is at least about 3 inches from a lower portion 133A of seam 110A (indicated as "B" in FIG. 4). In another embodiment, the rolled sleeve portion is at least about 6 inches from lower portion 133A of seam 110A. In a further embodiment, the rolled sleeve portion is between about 3 inches and about 6 inches from lower portion 133A of seam 110A.

In one embodiment, upper edge 130A of the rolled sleeve portion, illustratively rolled sleeve portion 116A, is at least about 2.5 inches from the original unrolled lower edge 114A of sleeve 104A (indicated as "C" in FIG. 4). In another embodiment, the rolled sleeve portion is at least about 5 inches from the original unrolled lower edge 114A of sleeve 104A. In a further embodiment, the rolled sleeve portion is between about 2.5 inches and about 5 inches from the original unrolled lower edge 114A of sleeve 104A.

In one embodiment, rolled sleeve portion 116A has a generally constant width W (see FIG. 4) about the circumference of sleeve 104A. In one embodiment, width W is about 0.7 inches. In another embodiment, width W is between about 0.7 inches and about 1.25 inches. Exemplary dimensions (in inches) based on layers of original sleeve material in rolled sleeve portion 116A are: three layers of original sleeve material (A≈6, B≈5.3, C≈2.5, W≈0.7), four layers of original sleeve material (A≈5, B≈4.5, C≈3.5, W≈0.9) and five layers of original sleeve material (A≈3.5, B≈3.5, C≈4.6, W≈1.1).

In one embodiment, the width of rolled sleeve portion 116A is chosen such that an indicia, such as a label, graphic, text, may be visible on an exterior of rolled sleeve portion 116A, illustratively on surface 125A of sleeve section 124A. In one example, the indicia provides a trade name, trademark, or other symbol associated with shirt 100 or a product or service being advertised or promoted with shirt 100. In one embodiment, the visible indicia is provided on a snugging member, such as snugging member 250, which in this embodiment is at least partially visible from an exterior of rolled sleeve portion 116A.

Figure 5:
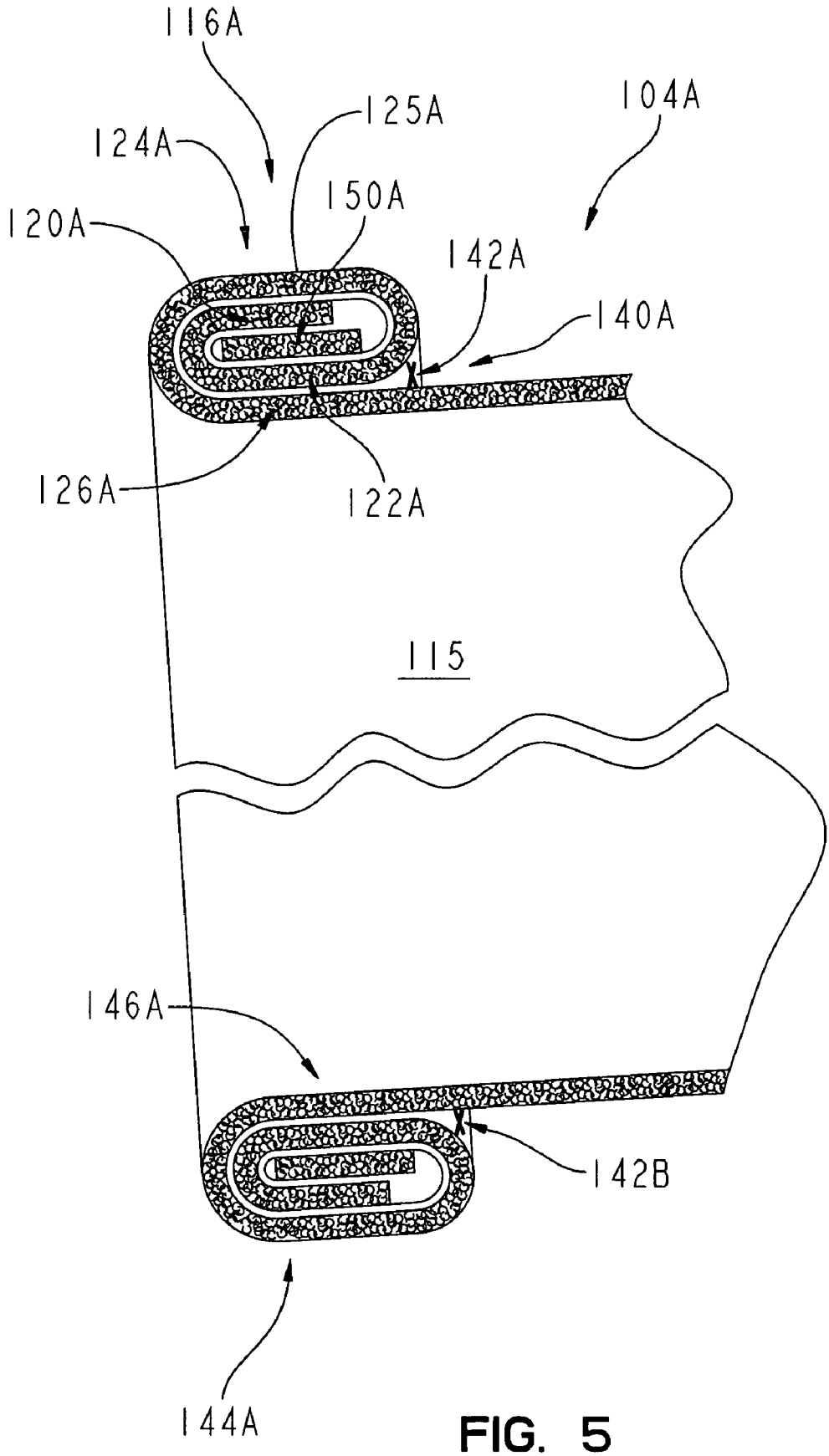
FIG. 5 is sectional view of the rolled right sleeve of FIG. 4.

Referring to FIG. 5, rolled portion 116A of T-Shirt 10 includes a securing member 140A, illustratively stitches 142A, 142B. Securing member 140A secures a first portion 144A (illustratively sleeve sections 120A, 122A, and 124A) of the rolled sleeve portion 116A to a second portion 146A (illustratively sleeve section 126A) of the rolled sleeve portion 116A. Illustratively stitches 142A, 142B secure section 122A of sleeve 104A to section 126A of sleeve 104A. Second portion 146A is contiguous with the remaining unrolled portions of sleeve 104A.

Exemplary securing members include permanent securing members, such as stitches 142A, 142B, which keep rolled portion 116A rolled and releasable securing members which permit rolled portion 116A to be unrolled, such as for cleaning. In a preferred embodiment, securing member 140A is hidden from view from the exterior of T-Shirt 100 when T-Shirt 100 is being worn by person 10 thereby capturing the traditional rolled up sleeve look while preventing the rolled sleeve portion 116A from falling down and or unrolling. In another embodiment, securing member 140A is at least partially visible from the exterior of T-Shirt 100 when T-Shirt 100 is being worn by person 10.

Securing member 140A is illustratively shown in FIG. 5 as stitches 142A, 142B. In one embodiment, stitches 142A, 142B are spaced apart around the circumference of sleeve 104A. In another embodiment, stitches 142A, 142B are apart of a continuous seam. In one embodiment, securing members 140A are positioned at various spaced apart locations around a circumference of sleeve 104A such that all portions of sleeve 104A are secured in the rolled configuration. Further, exemplary securing members include VELCRO brand hook and loop fasteners, buttons, zippers, fasteners, adhesives, or snaps. In another embodiment, rivets are used.

Figure 6:
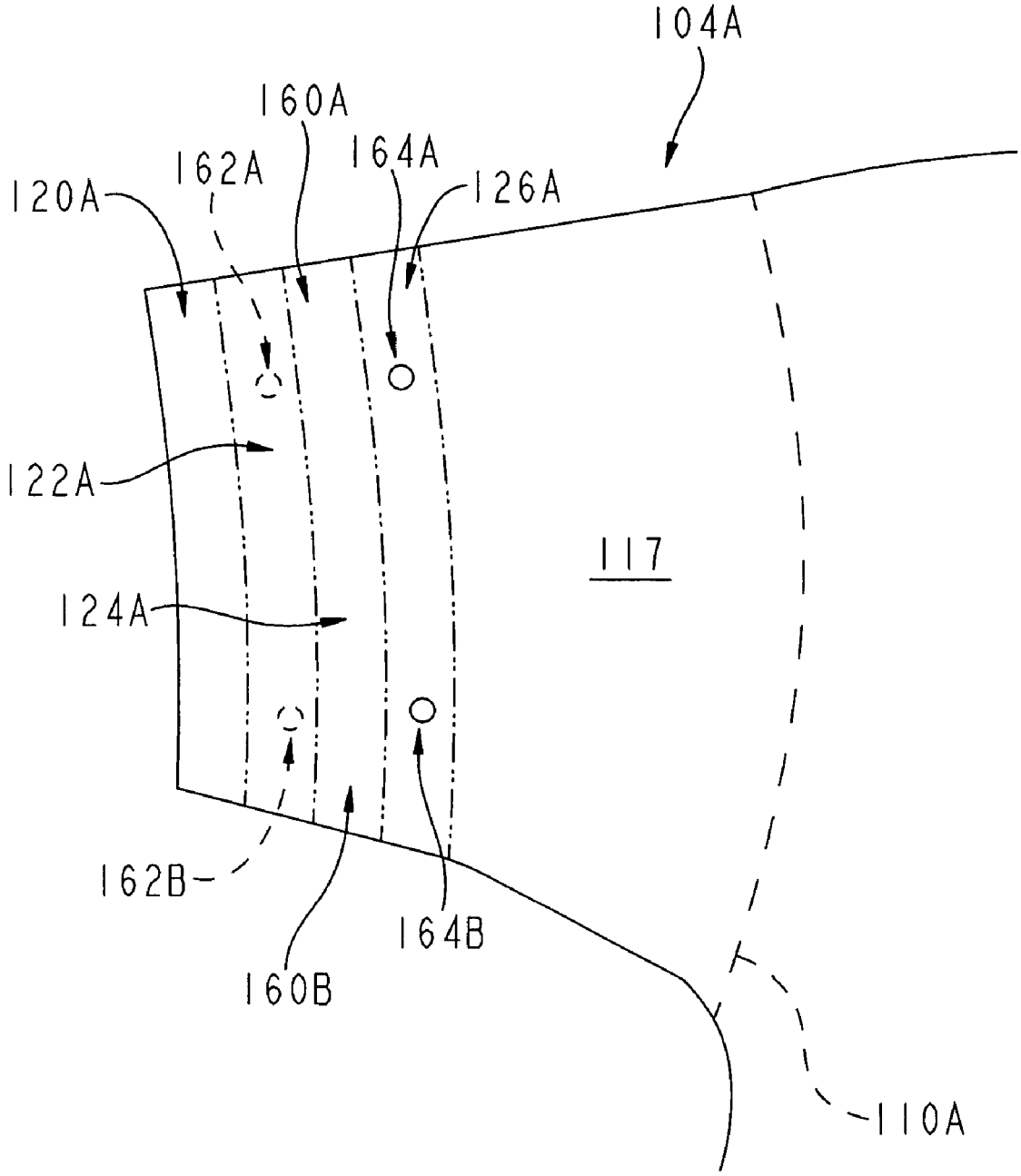
FIG. 6 is a front view of a portion of the T-Shirt of FIG. 1 including a right sleeve and exemplary releasable snugging members.

Referring to FIG. 6, right sleeve 104A is shown with an exemplary releasable securing member, illustratively snaps 160A, 160B. Each snap 160A, 160B includes a lower snap feature 162A, 162B, and an upper snap feature 164A, 164B. Lower snap features 162A, 162B are attached or coupled to an inside surface 115 (see FIG. 2) of sleeve 104A. Upper snap features 164A, 164B are attached or coupled to an outer surface 117 of sleeve 104A. Lower snap features 162A, 162B are illustratively attached to section 122A of sleeve 104A and upper snap features 164A, 164B, are illustratively attached to section 126A of sleeve 104A such that when sleeve 104A is rolled up three rolls lower snap features 162A, 162B are brought into engagement with upper snap features 164A, 164B, respectively. Once snap features 162A, 162B have snapped together with snap features 164A, 164B rolled sleeve portion 116A is secured in a rolled configuration and snaps 160A, 160B are not visible from the exterior of rolled sleeve portion 116A. However, since snaps 160A, 160B are releasable, rolled sleeve portion 116A may be unrolled for cleaning.

In the illustrated embodiment, a snugging member 150A is positioned within rolled sleeve portion 116A. Snugging member 150A contours the rolled sleeve portion 116A to the upper right arm 18A. In one embodiment, snugging member 150A is hidden from view from the exterior of the rolled sleeve portion 116A when the shirt 100 is worn by the person 10. Referring to FIGS. 1 and 5, snugging member 150A is a stretchable member, illustratively an elastic band 152A, which is placed within rolled sleeve portion 116A such that elastic band is not visible from the exterior of rolled sleeve portion 116A. Elastic band 152A is illustratively shown being located between sleeve section 120A and 122A, but it could be positioned anywhere within sleeve roll 116A.

In one embodiment, snugging member 150 contours rolled sleeve portion 116A such that it approximates the shape of the wearer's arm 18A. In one embodiment, this contouring is accomplished by gathering portions of sleeve 104A such that the snugging member 150 reduces the diameter of rolled sleeve portion 116A. In one embodiment, snugging member 150 is attached to an underside 119 (see FIG. 2) of sleeve 104A such that any gathering of material is not visible to an observer unless the wearer's arms 14A, 14B are raised.

In one embodiment, elastic band 152 is sewn or otherwise secured in place. In a preferred embodiment, elastic band 152 is not a complete ring or band, but is rather generally C-shaped as shown in FIG. 1. In another embodiment, elastic band 152 is not fixably coupled to sleeve 104A.

Figure 7:
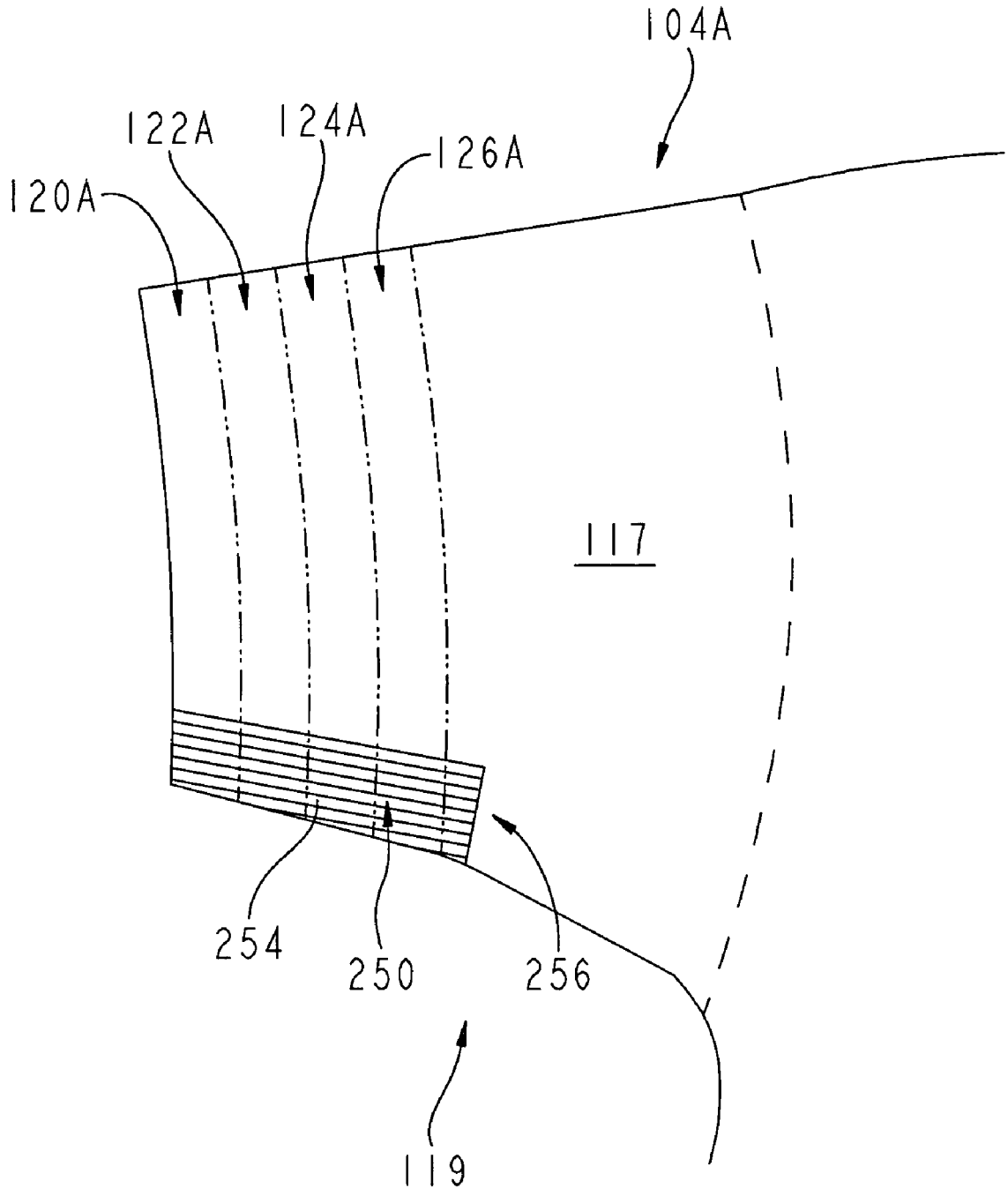
FIG. 7 is a front view of a portion of the T-Shirt of FIG. 1 including a right sleeve and an exemplary snugging member assembled to the right sleeve.

Referring to FIG. 7, a second exemplary snugging member 250 is shown. Snugging member 250 includes a portion of stretchable material 254 which is coupled to underside 119 of sleeve 104A. Exemplary stretchable material includes elastic, rubber, nylon and other suitable materials.

In one embodiment, snugging member 250 overlays the outer surface 117 of sleeve 104A and is coupled to outer surface 117. Exemplary forms of coupling include any of the suggested securing members. In another embodiment, snugging member 250 overlays the inner surface 115 of sleeve 104A and is coupled to inner surface 115. In a further embodiment, a portion of sleeve 104A, generally corresponding to the location of snugging member 250 is removed and a periphery of snugging member 250 is coupled to one of the outer surface 117 or inner surface 115 of the remainder of sleeve 104A.

The size of snugging member 250 may be chosen such that snugging member 250 is completely hidden from view by restricting snugging member 250 such that an upper edge 256 is located in one of sleeve sections 120A and 122A. Further, the size of snugging member 250 may be chosen, such that upper edge 256 is located in one of sleeve section 124A, sleeve section 126A, or beyond sleeve section 126A resulting in a portion of snugging member 250 being visible when the wearer 10 lifts his arms 14A, 14B.

Snugging members 150, 250 are each used to contour the sleeve 104A to make the upper arm 18A more closely approximate the size of opening 112A ("a snug fit"). Snugging members 150, 250, in effect, act to decrease the circumference of sleeve 104A to provide a snug fit about the circumference of the rolled portion 116A of sleeve 104A. However, snugging members 150, 250 generally do not disturb or alter the fit of T-shirt 100 in areas other than rolled portion 116A. In one embodiment, snugging member 150 or snugging member 250 is at least partially stretched prior to being attached to sleeve 104A to pre-load the snugging of sleeve 104A. In another embodiment, snugging member 150 or snugging member 152 is partially stretched during the rolling of sleeve 104A.

Figure 8:
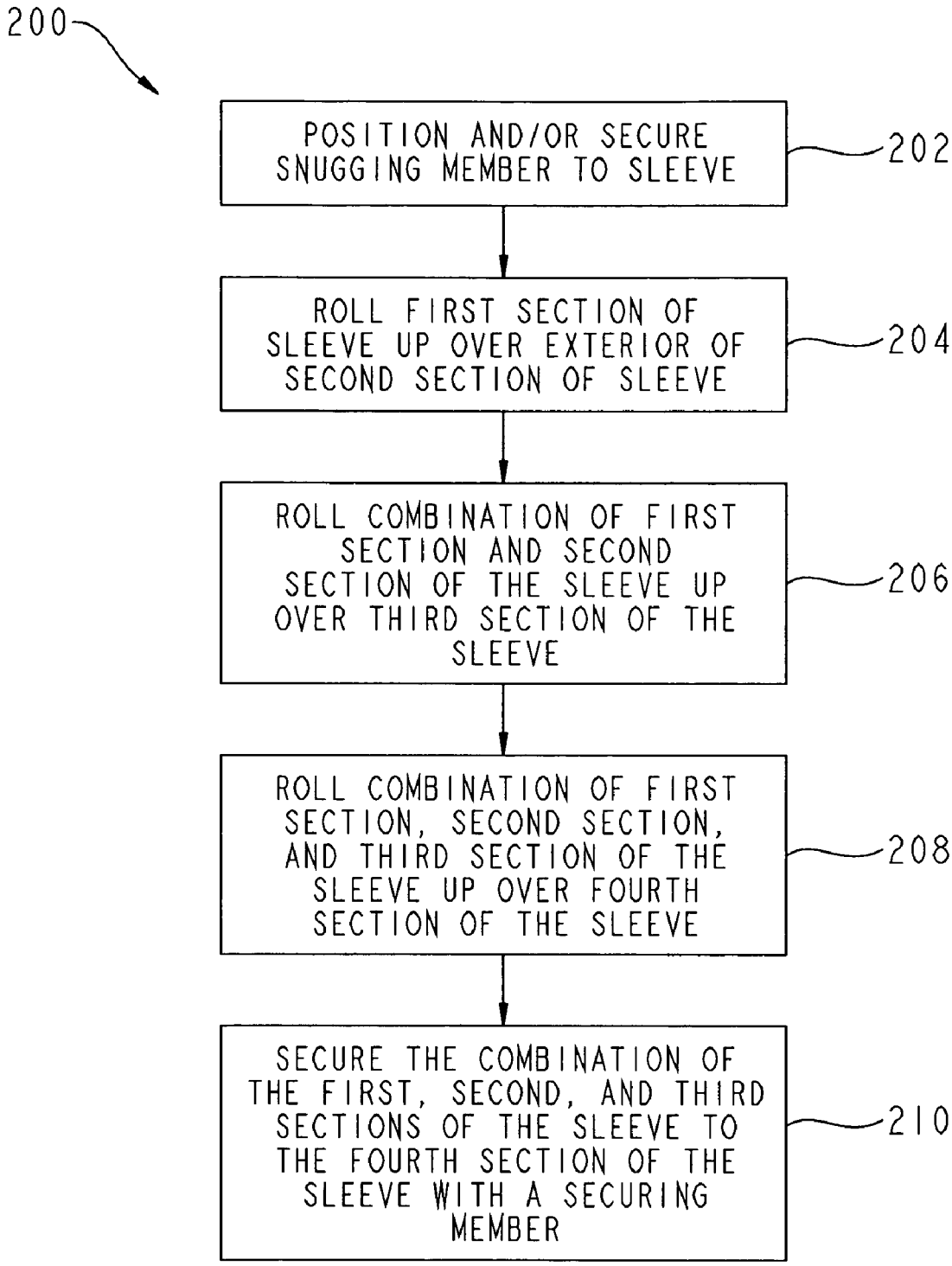
FIG. 8 is a flowchart of an exemplary method of rolling a sleeve of a T-Shirt.

Referring to FIG. 8 an illustrative method 200 of rolling sleeve 14 is provided. As represented by block 202, snugging member 150 or snugging member 250 is positioned and/or secured to sleeve 104. As represented by block 204, first section 120 of sleeve 104 is rolled up over an exterior of second section 122. As represented by block 206, the combination of first section 120 and second section 122 is rolled up over an exterior of third section 124. As represented by block 208, the combination of first section 120, second section 122, and third section 124 is rolled up over fourth section 126. As represented by block 210, the combination of first section 120, second section 122, and third section 124 is secured to fourth section 126 with one or more by securing member 140.

Although the invention has been described in detail with reference to certain illustrated embodiments, variations and modifications exist within the spirit and scope of the invention as described and defined in the following claims.

The invention claimed is:

1. A short sleeve shirt for wear by a person, the shirt comprising:

a torso portion configured to cover a portion of a torso of the person and an opening for a head of the person to extend out of when the short sleeve shirt is worn by the person;

a first sleeve made from an original sleeve material, the first sleeve being coupled to the torso portion at a first seam which is located to a first side of the opening in the torso portion for the head of the person to extend out of, the first sleeve being configured to cover at least a portion of an upper first arm of the person when the shirt is worn by the person and to leave exposed an entire lower first arm of the person when unrolled, the first sleeve being rolled from a lower edge of the first sleeve about a circumference of the first sleeve to produce a first rolled sleeve portion including at least three layers of the original sleeve material, the first rolled sleeve portion being positioned around a bicep of the upper first arm of the person when the short sleeve shirt is worn by the person;

a snugging member configured to contour the first rolled sleeve portion to the upper first arm of the person when the shirt is worn by the person, the snugging member including an elastic band which is placed within the first rolled sleeve portion between a first layer of original sleeve material and a second layer of original sleeve material on a underside of the first rolled sleeve portion; and a securing member configured to secure the first rolled sleeve portion in place when the shirt is worn by the person, the securing member being spaced apart from the first seam.

2. The shirt of claim 1, wherein the first rolled sleeve portion has a generally constant width about the circumference of the first sleeve.

3. The shirt of claim 2, wherein the first rolled sleeve portion includes a first portion including a single layer of original sleeve material and a second portion including at least one layer of original sleeve material, the first portion being contiguous with an unrolled portion of the first sleeve and the securing member being configured to secure the second portion of the first rolled sleeve portion to the first portion of the first rolled sleeve portion.

4. The shirt of claim 2, further comprising a second sleeve configured as a mirror image of the first sleeve.

5. The shirt of claim 1, wherein the snugging member is hidden from view from the exterior of the first rolled sleeve portion when the shirt is worn by the person.

6. The shirt of claim 1, wherein an outer surface of the first rolled sleeve portion includes a promotional indicia.

7. The shirt of claim 1, wherein the torso portion includes an unopenable lower edge.

8. The shirt of claim 1, wherein the snugging member leaves generally unaltered an unrolled sleeve portion extending between the first rolled sleeve portion and the first seam.

9. The shirt of claim 1, wherein the first sleeve has an unopenable lower edge when unrolled.

10. The shirt of claim 1, wherein the first seam has a top portion generally positioned adjacent a shoulder of the person when the shirt is worn by the person and a top edge of the first rolled sleeve portion is at least about 3 inches from the top portion of the first seam when the shirt is worn by the person, the top portion of the first seam being positioned about a shoulder of the person when the shirt is worn by the person.

11. The shirt of claim 1, wherein the securing member is a permanent type securing member which is spaced apart from the first seam when the first sleeve is rolled and the shirt is worn by the person.

12. The shirt of claim 11, wherein the securing member includes a plurality of stitches spaced about the rolled sleeve portion.

13. The shirt of claim 1, wherein the securing member is a releasable type securing member which is spaced apart from the first seam when the first sleeve is rolled and the shirt is worn by the person.

14. The shirt of claim 13, wherein the securing member includes a plurality of snaps spaced about the rolled sleeve portion.

15. The shirt of claim 1, wherein the first rolled sleeve portion has a generally constant width about a circumference of the first sleeve.

16. The shirt of claim 1, wherein the width of the first rolled sleeve portion is about 1 inch.

17. The shirt of claim 1, wherein the snugging member is hidden from view from the exterior of the rolled sleeve portion when the shirt is worn by the person.

18. The shirt of claim 1, wherein a top edge of the first right rolled sleeve portion is between about 2.5 inches and about 5 inches from the lower edge of the sleeve when unrolled.

* * * * *

UNITED STATES PATENT AND TRADEMARK OFFICE

CERTIFICATE OF CORRECTION

PATENT NO. : 7,650,650 B2
APPLICATION NO. : 11/132492
DATED : January 26, 2010
INVENTOR(S) : James A. Voege It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 599 days.

Signed and Sealed this

Twenty-eighth Day of December, 2010

David J. Kappos

David J. Kappos
*Director of the United States Patent and Trademark Office*